United States Patent [19]

Dye

[11] Patent Number: 4,491,315

[45] Date of Patent: Jan. 1, 1985

[54] TRAINING BAG FOR BOXING AND THE LIKE

[76] Inventor: Jeffrey Dye, 451 Howe Ave., Passaic, N.J. 07055

[21] Appl. No.: 421,254

[22] Filed: Sep. 22, 1982

[51] Int. Cl.[3] ..... A63B 69/00

[52] U.S. Cl. ..... 272/78; 273/55 A

[58] Field of Search ..... 273/55 A, 55 R; 272/76, 272/77, 78

[56] References Cited

U.S. PATENT DOCUMENTS

| | | | |
|---|---|---|---|
| 1,267,678 | 5/1918 | McArdle | 272/78 |
| 3,424,458 | 1/1969 | Hopps, Jr. | 273/55 R |
| 3,464,696 | 9/1969 | Hooker | 273/55 R |
| 3,637,210 | 1/1972 | Brantley | 273/55 R |
| 3,680,861 | 8/1972 | Schmidt | 273/55 R |
| 3,997,160 | 12/1976 | George | 273/55 R |

*Primary Examiner*—Richard C. Pinkham
*Assistant Examiner*—T. Brown
*Attorney, Agent, or Firm*—Steinberg & Raskin

[57] ABSTRACT

A training bag for boxing and the like includes two separate anatomical sections, namely a section representing the head and a section representing the body, supported on an elongated rod and mounted so that their positions can be relatively adjusted as desired. Each of the anatomical sections has a configuration including four vertical side surfaces and corresponding oblique surfaces which slant inwardly in the downward direction. Each of the head and body sections is formed of an inner rigid shell over which a layer of rubber covered by leather or canvas is provided. The physical characteristics of the bag can be varied by repositioning the head and body sections and by adding and deleting weights with a view toward the physical characteristics of the particular opponent of the boxer using the bag. Blows can be directed to both the front and lateral side surfaces of the bag to improve a fighter's timing and accuracy and, moreover, uppercuts and upwardly-directed hooks can be directed to the front and side oblique surfaces of both the head and body sections without the risk of injury to the fighter's hands. The body section has an enlarged lower portion which serves to enhance the fighter's leg and foot positioning abilities with respect to his opponent's.

17 Claims, 3 Drawing Figures

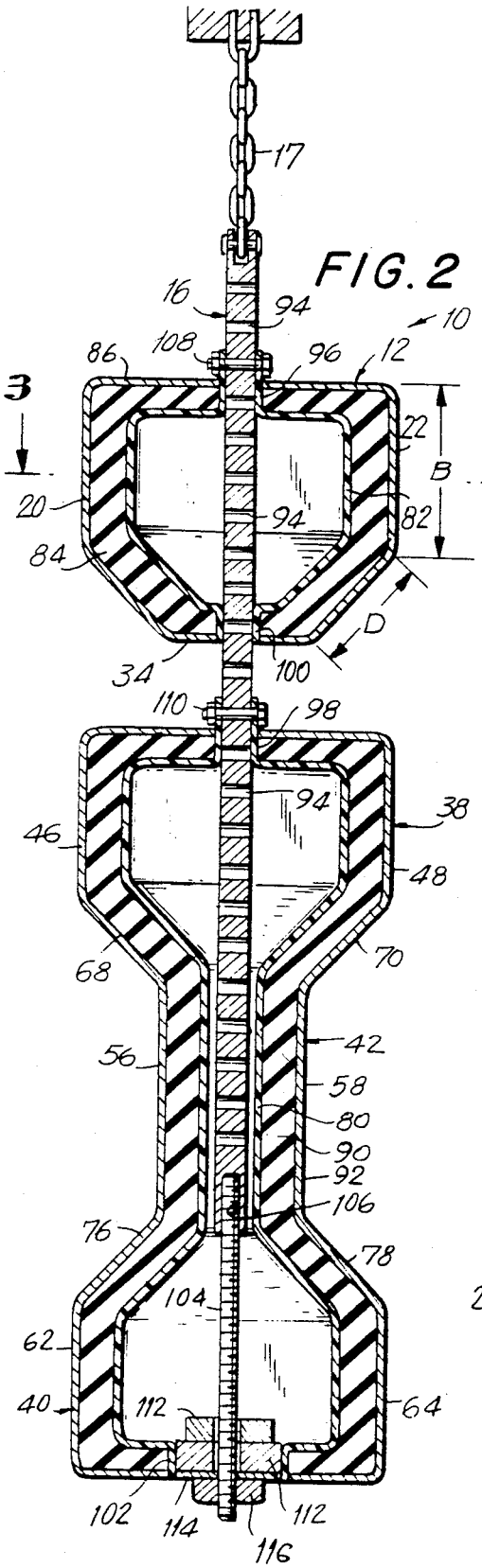
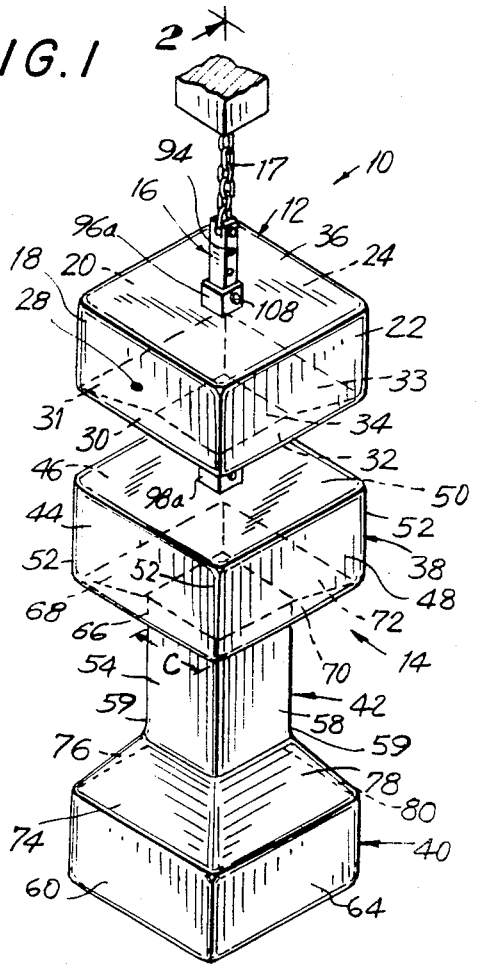
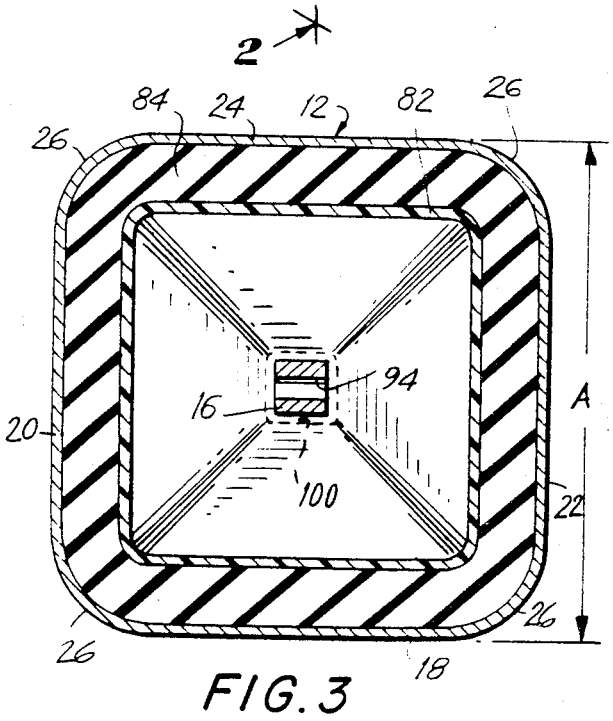
FIG. 3

TRAINING BAG FOR BOXING AND THE LIKE

BACKGROUND OF THE INVENTION

This invention relates generally to apparatus for use in training boxers and participants in other martial arts and, more particularly, to a new and improved training bag.

One of the most important types of training apparartus used by participants in the martial arts and especially by boxers is the punching bag. The so-called light or speed bag is a small leather bag that is suspended from a platform by a metal swivel. The primary purpose of working out with a speed bag is to develop speed of hand and increased punching speed and, in fact, the light bag is clearly limited to such purpose.

On the other hand, the so-called heavy bag is a large canvas- or leather-covered bag suspended from a platform filled with sand, sawdust or other suitable material and is used by a boxer to develop punching power. Thus, the heavy bag is primarily used for developing and improving punching force and leverage. Traditionally, the heavy bag is used either hanging free or held by a trainer to provide extra leverage but in either case, the heavy bag represents an opponent. In working out with a free-swinging heavy bag, a boxer also gets practice in using his weight to maneuver an opponent. Thus, the boxer can shove the bag away from him and throw one or more punches as it swings back towards him. The bag is shoved away again and the boxer can bob or duck out of the way as it returns or throw one or two hard punches. Thus, the heavy bag can be used in defensive drills by the boxer bobbing under it and to the side as it returns toward him.

Although the conventional heavy bag described above is useful in developing punching power, it is otherwise quite limited in its usefulness during training. More particularly, the heavy bag cannot be efficiently utilized by a boxer to sharpen his accuracy and timing, especially with respect to head and body combination punches, i.e., where a blow is first directed to the head and which is then followed up by a blow to the body and vice-versa. Moreover, the same heavy bag is generally utilized in training for a match for all opponents regardless of the height or weight of the particular opponent for whom the boxer is in training. Of course, it would be desirable for the boxer to direct his training efforts to the particular opponent whom he will next face.

Furthermore, an important deficiency in conventional heavy bags is that they are only useful in developing the power of certain types of punches. Thus, prior art heavy bags normally find use only in developing the power of jabs, i.e., straight punches delivered by the left hand of a right handed fighter or level hooks, i.e., punches delivered at close range from the side with the elbow swinging out and hooked. Thus, a heavy bag cannot be used to develop uppercuts, i.e., a rapidly rising blow delivered with the arm bent and straightening out as the body is stretched or straightened, or even to develop hooks which are directed upwardly, whether such blows are aimed at the region of the body or the head. In fact, fighters have been known to sprain or even break bones in their hands by hitting a heavy bag with an uppercut or upwardly-directed hook, especially when the bag is moving toward the boxer.

Another disadvantage of conventional heavy bags is that such bags fail to provide the so-called "bounceback" after a punch is landed which occurs in an actual match when a boxer lands a punch. Thus, the boxer's gloved hand will tend to sink in or be absorbed by a heavy bag which does not accurately simulate what in fact occurs in an actual fight.

SUMMARY OF THE INVENTION

Accordingly, one object of the present invention is to provide new and improved training bags for boxers and participants in other martial arts.

Another object of the present invention is to provide a new and improved training bag which can be utilized by a boxer to sharpen his accuracy and timing, especially with repsect to hand and body combination punches.

Still another object of the present invention is to provide a new and improved training bag whose characteristics can be varied with a view toward the physical characteristics of the particular opponent whom the user of the bag is in training to fight.

A further object of the present invention is to provide a new and improved training bag which is useful in developing all types of punches normally thrown by a fighter, including not only jabs and level hooks, but also uppercuts and upwardly-directed hooks.

A still further object of the present invention is to provide a new and improved training bag for fighters which will simulate in an accurate manner the bounceback which will occur after a punch has landed in an actual fight.

Yet another object of the present invention is to provide a new and improved training bag which is not limited for use only by boxers but which can be used by participants in practically all other martial arts, i.e., which is suitable in developing the accuracy, timing and power of blows delivered not only by the hands, but also by the elbows, feet and knees.

Briefly, in accordance with the present invention these and other objects are attained by providing a training bag having one or more of the following features, either singly or in combination with each other. Thus, according to one feature of the invention, the training bag is constituted by two separate anatomical sections, namely a section representing the head of an opponent and a section representing the opponent's body. By this provision, the fighter's punching accuracy to the head and body as well as his timing of combination punches can be improved. According to another feature, the anatomical sections are supported by an elongated rod on which the sections are mounted so that their positions thereon can be selectively adjusted as desired in consideration of the physical characteristics, namely, the height, of the particular opponent for whom the boxer is in training.

According to an important feature of the invention, each of the anatomical sections has a contoured configuration which will not only improve the fighter's timing of his punches but which will also allow the fighter to improve the power and accuracy of all types of punches. Thus, in a preferred embodiment, the head section is formed with four vertical side surfaces and corresponding oblique surfaces which slant inwardly in the downward direction. Similarly, the body section has an upper portion formed with four vertical side surfaces and corresponding oblique surfaces slanting inwardly in the downard direction, a reduced intermediate portion and an enlarged lower portion. In this manner, blows can be directed to the vertical side surfaces which are representative of the front and sides of both the body and the head to improve the timing and accuracy thereof. Moreover, uppercuts and upwardly-directed hooks can be directed to the front and side oblique surfaces of both the head and body sections without the risk of injury of the fighter's hands. The enlarged lower portion of the body section will allow the boxer to practice bobbing and weaving as the fighter steps in and out and side to side while the bag swings to thereby improve his footwork. Moreover, these features both alone and in combination with the other features described above renders the bag suitable for use in other martial arts to improve the timing and accuracy of blows delivered by the elbows, feet and knees, as well as by the hands.

The training bag of the present invention is preferably constructed of an inner plastic shell defining a hollow interior. A layer of rubber covered by leather or canvas overlies the shell. In this manner, the bag provides an accurate bounceback effect when a blow is landed. Moreover, the plastic shell assures that the bag will be durable and will not lose its shape over long periods of use.

According to still another feature of the invention, weights may be added or deleted from the bag to render the same heavier or lighter as desired. In fact, weights may be added to the bag to an extent such that the bag will remain substantially stationary even as blows are landed.

DESCRIPTION OF THE DRAWINGS

A more complete appreciation of the present invention and many of the attendant advantages thereof will be readily understood by reference to the following detailed description when considered in connection with the accompanying drawings in which:

FIG. 1 is a perspective view of a training bag in accordance with the present invention;

FIG. 2 is a section view taken along line 2—2 of FIG. 1; and

FIG. 3 is a section view taken along line 3—3 of FIG. 2.

DESCRIPTION OF THE PREFERRED EMBODIMENT

Referring now to the drawings wherein like reference characters designate identical or corresponding parts throughout the several views, a training bag in accordance with the present invention, generally designated 10, comprises a pair of anatomical sections, namely a head section 12 and a separate body section 14, mounted on an elongated rod 16 in a manner described below so that their positions thereon can be selectively adjusted. The rod 16 is suspended from a platform or the like by means of a chain 17 and a spring may be interposed along the length of the chain if desired.

The head section 12 is formed with four vertical side surfaces, namely a front side surface 18, a pair of lateral side surfaces 20 and 22 and a rear side surface 24, which merge with each other at four rounded corners 26 (FIG. 3). The front side surface 18 may be marked with appropriate indicia 28 to distinguish it from the other side surfaces.

Each vertical side surface 18, 20, 22 and 24 merges into a corresponding oblique surface 30, 31, 32 and 33, each of which slants or slopes downwardly and inwardly from a respective one of the side surfaces and merges into a common horizontal bottom surface 34. A horizontal top surface 36 completes the head section 12.

The body section 14 has an upper portion 38, a lower portion 40 and an intermediate portion 42 interconnecting the upper and lower portions. The upper portion 38 of body secction 14 is formed with four vertical side surfaces, namely a front side surface 44, substantially coplanar with the front side surface 18 of the head section, a pair of lateral side surfaces 46 and 48 and a rear side surface 50, which merge with each other at four rounded corners 52. The intermediate portion 42 is of reduced transverse dimension relative to the upper portion 38 and is formed of a vertical front side surface 54, a pair of vertical lateral side surfaces 56 and 58 and a vertical rear side surface (not shown) which merge with each other at four rounded corners 59. The lower portion 40 of body section 14 has an enlarged transverse dimension relative to the intermediate portion 42 and is formed of a vertical front side surface 60, a pair of vertical lateral side surfaces 62 and 64 and a vertical rear side surface (not shown).

The vertical side surfaces 44, 46, 48 and 50 of the upper portion 38 of body section 14 are connected to the vertical side surfaces 54, 56, 58 and 60, respectively, of the intermediate portion 42 by corresponding ones of four oblique surfaces 66, 68, 70 and 72. Thus, the four oblique surfaces slope downwardly and inwardly from the lower edges of the front, two lateral and rear side surfaces, respectively.

As will be described in greater detail below, at least the front and two lateral oblique surfaces 30, 31 and 32 of head section 12 and at least the front and two lateral oblique surfaces 66, 68 and 70 of body section 14 are surfaces against which uppercuts and/or upwardly-directed hooks or upwardly directed blows from the elbows, feet or knees can be delivered. The surfaces are angled so as to represent the chin region of the boxers opponent in the case of oblique surfaces 30, 31 and 32 and the chest region in the case of oblique surfaces 66, 68 and 70 when the boxer's opponent is in a crouch position or is advancing toward the boxer with his head facing down.

As noted above, the lower portion 40 of body section 14 has an enlarged transverse dimension relative to that of the intermediate portion 42. Thus, the four vertical side surfaces of the intermediate portion 42 are connected to corresponding vertical side surfaces of the lower portion 40 by respective downwardly and outwardly sloped oblique surfaces 74, 76, 78 and 80.

Referring to FIG. 2, the head section 12 is constructed of an inner hollow rigid shell 82, preferably formed of rigid plastic, which gives the head section 12 its desired shape as described above. A layer 84 of rubber or similar resiliently deformable material and an outer leather or canvas covering 86 are provided over the shell 82. Similarly, the body section 14 is constructed by a form-giving inner hollow rigid shell 88 over which a layer 90 of rubber or the like and a leather or canvas covering 92 are provided. In a preferred embodiment, both the head and body sections 12 and 14 have square transverse cross-sections, the transverse dimension A (FIG. 3) and longitudinal dimension B (FIG. 2) of each vertical side surface of the head section and upper and lower portions of the body section is about 18 inches and 9 inches, respectively. The transverse dimension C (FIG. 1) of each vertical side surface of the intermediate portion of the body section is about 6 inches. The longitudinal dimension D (FIG. 2) of each oblique surface is about 8 inches. The total height of the body section is about 3 feet, 2 inches. The thickness of the layer 84 of rubber-like material is about 2 inches.

As noted above, the head and body sections 12 and 14 are mounted on the elongated rod 16 so as to be adjustably positionable thereon. Thus, the height of the head and body sections can be independently adjusted with a view to the physical characteristics of the particular opponent for whom the boxer is in training. This feature is accomplished in the illustrated preferred embodiment as follows. A series of through-bores 94 are formed in rod 16 along the length thereof. The top sides of rigid shells 82 and 88 of head and body sections 12 and 14 have central upwardly extending collars 96 and 98 integrally formed thereon which extend through suitable openings provided in the rubber layers and canvas or leather covering and each collar has a protruding portion 96*a* and 98*a* through which a pair of aligned openings are formed. A lower downwardly depending collar 100 axially aligned with collar 96 is formed in substantially the same manner in the bottom side of shell 82 of head section 12 although without a portion protruding beyond the covering. The cross section of collars 96, 98 and 100 substantially correspond to that of rod 16 so that the latter can be inserted therethrough with only a slight clearance. The bottom side of shell 88 or body section 14 is also formed with a similarly constructed downwardly depending lower collar 102 which is axially aligned with upper collar 98. However, collar 102 has an enlarged transverse dimension relative to the other collars and is preferably circular for reasons discussed below.

Preparatory to mounting the head and body sections on rod 16 suspended from chain 17, one end of an elongated threaded member 104 (FIG. 2) is fastened in an axial bore 106 formed in the lower end of rod 16 so that the threaded member forms an axial continuation of rod 16. The purpose of threaded member 104 is discussed in detail below.

The head and body sections 12 and 14 are mounted on rod 16 by inserting the rod and threaded member, first through the axially aligned pair of collars 96, 100 of head section 12 and then through the axially aligned pair of collars 98, 102 of body section 14. The head and body sections are then positioned on rod 16 at their respective desired heights as probably determined by the physical characteristics of the boxer's next opponent and the two pairs of openings formed in collars 96 and 98 are aligned with the respective two bores 94 of rod 16 which are nearest to them. Respective bolts 108 and 110 or other elongated fasteners are then passed through the aligned openings in bores and fastened by nuts to thereby support the head and body sections 12 and 14 on rod 16 at their appropriate heights. Since the cross sections of collars 96 and 100 of head section 12 correspond to that of rod 16, the head section 12 will not wobble thereon. Moreover, the cross-sections of the rod 16 and collars 96 and 98 are preferably other than circular so that the anatomical sections will not be able to rotate with respect to the rod or with respect to each other during use.

The length of the threaded member 104 is such that its lower end extends to the region of the lower enlarged collar 102 of body section 14. The lower end region of threaded member 104 functions to support one or more weights as desired to provide the training bag 10 with the particular weight characteristics desired. More particularly, one or more weights 112 (two shown), preferably of circular shape having central apertures formed therein, are positioned on the lower region of threaded member 104 so as to be received in the recess formed by the lower enlarged collar 102. It is noted that since the hollow interior of shell 88 communicates with the collar recess, several weights 112 may be stacked on each other within the interior of the shell. A bearing plate 114 is then positioned under weights 112 and a nut 116 fastened on the end of threaded member 104 to thereby hold the weights. The configuration of bearing plate 114 corresponds to the transverse cross section of collar 102 so that with the plate at least to some extent being situated within the collar, the body section 14 will not wobble on rod 16.

It is seen from the foregoing that a training bag is provided which accomplishes all of the objects of the invention. By virtue of the feature wherein a pair of separate and distinct anatomical sections are provided which are representative of the head and body of an opponent, a boxer will be able to sharpen the accuracy of his punches to the head and body and improve his timing of combination punches, e.g., where a blow is delivered first to the head which is quickly followed up by a blow to the body, or vice-versa. By providing the head and body sections to be separately and independently adjustable in position both in height and with respect to each other, the bag can be quickly and easily adjusted with a view to the particular physical characteristics of the boxer's next opponent.

The particular contoured configuration of the head and body sections also give rise to important advantages. First, by providing each anatomical section with a front, a pair of lateral, and a rear side surface, which are representative of the front, sides and back of an opponent, a fighter will be able to improve his accuracy of straight jabs as well as hooks and, additionally, improve his timing and footwork, such as by attempting to stay in front of or to one side of the bag. By providing each anatomical section with oblique surfaces both at the front and at the sides thereof, which are representative of the chin and cheek regions (with the fighter's head tilted) in the case of the head section and of the chest region (with the fighter in a crouched position or advancing with his head down), a fighter will be able to practice uppercuts and upwardly-directed hooks to both the head and body to both improve the power of his punches as well as timing and accuracy. The risk of a fighter spraining or breaking his hands which sometimes occurred when using conventional heavy bags is eliminated due to the particular angle at which the oblique surfaces extend. The enlarged lower portion 40 of the body section 14 is advantageous in that it represents the opponent's legs and knees and requires the boxer to maintain certain distances from the bag thereby improving the fighter's footwork while strengthening his legs and knees.

Importantly, the features of the invention described above renders the bag especially suitable for use in practicing other martial arts. Thus, the use of separate anatomical sections and the contoured nature thereof allows the timing and accuracy of blows to the head and body delivered by the feet, knees and elbows to be improved.

The construction of the bag with a rigid inner shell having an outer layer of rubber or rubber-like material and leather or canvas provide the structure with a "bounceback" which is more nearly representative of the bounceback presented by the human body when a punch is landed than that provided by a conventional bag. This will improve the reflexes of the boxer who uses the bag.

Finally, the provision that the weight of the bag is completely adjustable and can be increased or decreased as desired is an important feature allowing the boxer to suit his particular training needs or take the weight of his next opponent into account.

Obviously, numerous modifications and variations of the present invention are possible in the light of the above teachings. For example, it is not necessary to use the particular collar type rod mounting arrangement or the mounting arrangement for the weights as disclosed. Accordingly, it is understood that within the scope of the claims appended hereto, the invention may be practiced otherwise than as specifically disclosed herein.

What is claimed is:

1. Training bag-type apparatus for use by boxers and participants in other martial arts, comprising:

means for supporting at least two separate anatomical sections, said support means including elongated rod means;

said at least two anatomical sections mounted on and supported by said support means, said anatomical sections including a section representative of the head of an opponent and a section representative of the body of an opponent;

means for mounting said head and body sections on said rod means so as to be selectively adjustable in position with respect thereto, said mounting means including collar means provided on each of said head and body sections through which said rod means is adapted to pass; and wherein a series of bores are formed through said rod means along the length thereof and wherein openings are formed in said collar means adapted to be aligned with respective ones of said bores and fastener means adapted to be inserted through said aligned openings and bores for securing said head and body sections in position on said rod means.

2. The combination of claim 1 wherein said rod and collar means have corresponding non-circular transverse cross sections.

3. The combination of claim 1 wherein each of the head and body sections have a contoured configuration representative of at least the front and sides of an opponent.

4. The combination of claim 3 wherein each of said head and body sections includes at least a front side surface and a pair of lateral side surfaces.

5. The combination of claim 4 wherein said front and lateral side surfaces extend substantially in a vertical plane.

6. The combination of claim 4 wherein each of said head and body sections includes a vertical front side surface, a pair of vertical lateral side surfaces, and a vertical rear side surface.

7. The combination of claim 4 wherein said front and lateral side surfaces merge with each other at rounded corners.

8. The combination of claim 4 wherein each of said head and body sections further include at least one oblique surface extending from a side surface sloping downwardly and inwardly.

9. The combination of claim 8 wherein each of said head and body sections include three oblique surfaces, said oblique surfaces sloping downwardly and inwardly from said vertical front and two lateral side surfaces, respectively.

10. The combination of claim 3 wherein said body section includes an upper portion, an intermediate portion having a reduced transverse dimension relative to said upper portion, and a lower portion having an enlarged transverse dimension relative to said intermediate portion.

11. The combination of claim 10 wherein said upper portion of said body section includes front and lateral side surfaces extending substantially in a vertical plane and at least one oblique surface extending from a side surface sloping downwardly and inwardly.

12. The combination of claim 1 wherein each of said head and body sections is formed of an inner rigid shell, a layer of resilient and deformable material overlying said shell and a flexible covering overlying said layer.

13. The combination of claim 1 further including means for removably attaching a selected number of weights to said apparatus.

14. The combination of claim 13 wherein said support means are constituted by elongated rod means and said weight attaching means are constituted by means for removably attaching weights to said rod means.

15. The combination of claim 14 wherein said weight attaching means are constituted by an elongated member adapted to be fixed to said rod means and means for removably attaching weights to said elongated member.

16. Training bag-type apparatus for use by boxers and participants in other martial arts, comprising:

means for supporting at least two separate anatomical sections, said support means including elongated rod means;

said at least two anatomical sections mounted on and supported by said support means, said anatomical sections including a section representative of the head of an opponent and a section representative of the body of an opponent;

means for removably attaching weights to said rod means, said weight attaching means including an elongated member adapted to be fixed to said rod means and means for removably attaching weights to said elongated member; and wherein a recess is formed in the bottom of said body region and a lower region of said elongated member extends into said recess, said recess adapted to receive said weights.

17. Training bag-type apparatus for use by boxers and participants in other martial arts, comprising:

means for supporting at least two separate anatomical sections, said support means including elongated rod means;

said at least two anatomical sections mounted on and supported by said support means, said anatomical sections including a section representative of the head of an opponent and a section representative of the body of an opponent; and means for mounting said head and body sections on said rod means so as to be selectively adjustable in position thereon, and wherein each of said head and body sections includes at least a vertical front side surface, a pair of vertical lateral side surfaces and at least three oblique surfaces which slope downwardly and inwardly from said vertical front and two lateral side surfaces, respectively.

* * * * *